US006980761B2

(12) United States Patent
Yamada

(10) Patent No.: US 6,980,761 B2
(45) Date of Patent: Dec. 27, 2005

(54) IMAGE FORMING APPARATUS

(75) Inventor: Masatomo Yamada, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 124 days.

(21) Appl. No.: 10/773,444

(22) Filed: Feb. 9, 2004

(65) Prior Publication Data

US 2004/0228664 A1 Nov. 18, 2004

(30) Foreign Application Priority Data

Feb. 10, 2003 (JP) ..... 2003-032567

(51) Int. Cl.[7] ..... G03G 15/01
(52) U.S. Cl. ..... 399/302; 399/308
(58) Field of Search ..... 399/297, 298, 399/299, 302, 308

(56) References Cited

U.S. PATENT DOCUMENTS 6,445,900 B2 * 9/2002 Fukao et al. ..... 399/302
6,625,410 B2 * 9/2003 Sato et al. ..... 399/165
6,816,178 B2 * 11/2004 Yamada et al. ..... 347/116

FOREIGN PATENT DOCUMENTS

JP 9-90779 4/1997
JP 11-109767 4/1999
JP 2002-341706 11/2002

* cited by examiner

*Primary Examiner*—Hoan Tran
(74) *Attorney, Agent, or Firm*—Morgan, Lewis & Bockius LLP

(57) ABSTRACT

An image forming apparatus is provided with a photosensitive drum in which a toner image is formed on surface thereof; an intermediate transfer belt to which the toner image of the photosensitive drum is transferred via a primary transfer portion and the transferred toner image is transferred via a secondary transfer portion to a paper; and a wrap-out roller which abuts against a rear surface of this intermediate transfer belt so as to apply tension to the intermediate transfer belt. This wrap-out roller forms the primary transfer portion which causes the intermediate transfer belt to abut against the photosensitive drum in a wrap shape, and forms a flat plane portion toward the secondary transfer portion. This wrap-out roller is arranged within a projection area which is directed from a secondary transfer roller toward the photosensitive drum.

17 Claims, 6 Drawing Sheets

IMAGE FORMING APPARATUS

BACKGROUND OF THE INVENTION

1. Title of the Invention

The present invention relates to an image forming apparatus such as a printer, a copying machine, and a facsimile machine, and more relates to make the image forming apparatus compact.

2. Description of the Related Art

In image forming apparatus known as a printer, a copying machine, and a facsimile machine, which employ electrophotographic systems, images are formed as follows: that is, after light is irradiated onto an image carrier such as a photosensitive drum which has been uniformly charged by electrostatic latent image forming unit to acquire electrostatic latent images, toners are applied to the electrostatic latent images so as to be visualized by developing unit. Then, for example, a plurality of toner images are multiplex-transferred onto an intermediate transfer member. The multiplexed toner image is transferred onto a recording medium (such as a paper) so that the toner image is fixed on the recording medium.

In related art, such a technical idea is known (refer to, for example, JP-A-11-109767 at pages 4 to 5, FIG. 1). That is, a rotary type developing apparatus is provided in proximity to a photosensitive drum, which holds four colors (yellows magenta, cyan, and black) of developing devices functioning as developing device along a circumferential direction of a rotary member. Toner images which are sequentially formed by this rotary type developing apparatus are transferred onto a transfer belt in a multiplexing manner. In the image processing apparatus of a system as indicated in JP-A-11-109767, when a full color image is outputted, every time the transfer belt is rotated by one turn, a yellow-color toner image, a magenta-color toner image, a cyan-color toner image, and a black-color toner image are primary-transferred onto this transfer belt. The four color toner images are sequentially overlapped with each other on the transfer belt. Then, the toner image is secondary-transferred onto a paper by employing a secondary transfer roller at a secondary transfer position from a portion where all of these four color toner images have been overlapped with each other.

At this time, in JP-11-109767, such a layout is designed in which the distance between the primary transfer portion and the secondary transfer portion becomes long in order that the tip portion of the toner image is not reached to the secondary transfer portion before the primary transfer operation as to such a paper whose transport length is long is completely accomplished. Other than JP-11-109767, another technical idea is known (refer to, for example, JP-9-90779 at pages 3 to 5, FIGS. 1 and 3). That is, in a color image forming apparatus in which a toner image formed on an image carrier is primary-transferred to an intermediate transfer member, and then, the toner image on the intermediate transfer member is secondary-transferred to a transfer medium (such as a paper), a distance defined from a primary transfer position up to a secondary transfer position is set to be longer than the maximum length of the transfer member. As previously explained, since the distance defined from the primary transfer position up to the secondary transfer position is set to be longer than the maximum length of the transfer material, it is possible to avoid that the primary transfer operation is carried out during the secondary transfer operation. Thus, the speed variation occurred when the transfer material rushes into the secondary transfer position can be prevented.

Furthermore, another image forming apparatus which employs the following system has been proposed (refer to, for instance, JP 2002-341706 at pages 3 to 5, FIG. 1). In this image forming system, in order that a plurality of color images are superimposed with each other on an intermediate transfer belt and the superimposed color image is transferred so as to obtain a color image, a recording medium storage unit is arranged at a lower side of this image forming apparatus, a transfer material is transported along a substantially vertical direction, and after an image is formed on this transfer material, this transfer material is ejected to an ejection unit provided on an upper side of this apparatus. In the layout described in JP 2002-341706, an intermediate transfer belt is arranged on the upper side of the rotary developing apparatus, and the ejection tray is provided above this intermediate transfer belt.

In the technical ideas described in the patent JP-11-109767 and JP-9-90779, however, since the distance between the primary transfer position and the secondary transfer position is very long, for instance, a time duration until the secondary transfer operation is carried out after the primary transfer operation has been carried out is prolonged, and thus, a so-called "throughput time" becomes very long. Furthermore, in the technical ideas described in JP-11-109767 and JP-9-90779, the distance defined between the primary transfer position and the secondary transfer position is long, so that the image forming apparatus becomes bulky.

In JP2002-341706, a solving device with respect to entering of the transfer material into the secondary transfer position is not completely disclosed. Shocks occurred when the transfer material is entered into the secondary transfer position cannot be prevented. A so-called "smear" which is caused by such a phenomenon that the transfer material scrapes the surface of the intermediate transfer belt cannot be avoided.

SUMMARY OF THE INVENTION

It is an object of the present invention to provide an image forming apparatus capable of being made compact by arranging a primary transfer position in proximity to a secondary transfer position.

It is an another object of the present invention to realize that papers are smoothly entered into the secondary transfer position.

It is a further object of the present invention to suppress an image quality problem, which is caused by that papers rush to the secondary transfer position.

To achieve these objects, an image forming apparatus according to the present invention is featured by arbitrarily employing the following ideas: That is, while both a primary transfer portion and a secondary transfer portion are formed by sandwiching either a position determining device or a tension roller, an intermediate transfer member is arranged in an endless belt shape made of an elastic material. Furthermore, the respective structural elements are properly arranged as a proper layout in order that an entering angle of a paper constitutes a predetermined angle. Therefore, the image forming apparatus of the present invention can shorten time required to output a print, can be made compact, and also, can stabilize the image quality.

According to one aspect of the invention, there is provided with an image forming apparatus including: primary transferring device for transferring a toner image formed on an image carrier to an intermediate transfer member; secondary transferring device provided in proximity to the primary transferring device on downstream side of the primary transferring device along a pivotal rotation direction of the intermediate transfer member, for transferring the toner image which has been once held by the intermediate transfer member to a paper; and position determining device abutting against a plane of the intermediate transfer member where the toner image is not held, for determining a position between the primary transferring device and the secondary transferring device.

According to another aspect of the invention, there is provided with the primary transferring device causes the intermediate transfer member to abut against the image carrier in a wrap shape so as to transfer the toner image to the intermediate transfer member.

According to another aspect of the present invention, there is provided with the secondary transferring device forms a secondary transfer portion by a secondary transfer member which is located opposite to a plane of the intermediate transfer member where the toner image is held, wherein the position determining device forms a flat plane portion by the intermediate transfer member, and.

According to another aspect of the invention, if the flat plane portion formed by the position determined device is featured by being inclined at a predetermined angle with respect to a paper transport path, then this construction is preferable as to the following aspect: This construction may suppress that a tip portion of a paper is contacted to the intermediate transfer member until the paper reaches the second transfer portion, and also a shock occurred when the tip portion of the paper rushes into the secondary transfer portion may be relaxed.

According to another aspect of the invention, this paper transport path may be formed on a surface of a toner collecting vessel which collects a toner left on the image carrier, and may be formed in such a manner that a rush angle at which the paper rushes from the paper transport path with respect to the secondary transfer portion becomes smaller than, or equal to 45 degrees. More preferably, the predetermined angle at which the paper is entered is larger than, or equal to 20 degrees and smaller than, or equal to 35 degrees.

According to another aspect of the invention, there is provided with an image carrier including an image carrier forms a toner image on a surface of the image carrier; an intermediate transfer member to which the toner image formed on the image carrier is transferred via a primary transfer portion, and which transfers the transferred toner image via a secondary transfer portion to a paper; and a tension roller abutting against an rear surface of the intermediate transfer member so as to apply tension to the intermediate transfer member, wherein the tension roller forms the primary transfer portion, the tension roller forms a flat plane portion directed to the secondary transfer portion, and the tension roller is arranged within a projection area which is directed from a secondary transfer member for forming the secondary transfer portion to the image carrier. At this time, as to the flat plane portion formed by this tension roller, a paper which is transported from a substantially vertical lower portion may be entered into this flat plane portion. It should be understood that this tension roller need not be completely involved in this projection area, but even a portion of this tension roller may be involved within this projection area.

According to another aspect of the invention, there is provided with an image apparatus including the paper transported from a substantially vertical lower direction is entered into the flat plane portion formed by the tension roller at a predetermined angle.

According to another aspect of the invention, there is provided with the predetermined angle is smaller than or equal to 45 degrees.

According to another aspect of the invention, there is provided with the predetermined angle is larger than, or equal to 20 degrees and smaller than, or equal to 35 degrees.

According to another aspect of the invention, there is provided with intermediate transfer member is a belt member made of an elastic member According to another aspect of the invention, there is provided with an image forming apparatus including an image carrier in which a toner image is formed on a surface of the image carrier; an intermediate transfer belt made of an elastic belt, which abuts against the image carrier in a wrap shape at a primary transfer portion, and once holds the toner image formed on the image carrier; a secondary transfer member for transferring the toner image which is once held on the intermediate transfer belt to a paper at a secondary transfer portion; and a position determining member provided inside the intermediate transfer belt and provided between the primary transfer portion and the secondary transfer portion, for determining both a position of the primary transfer portion and a position of the secondary transfer portion.

According to another aspect of the invention, there is provided with an image forming apparatus, if the position determining member is featured in that the position determining member forms a flat plane portion between the own position determining member and the secondary transfer member, then it is preferable that the paper may be smoothly entered into the secondary transfer portion.

According to another aspect of the invention, there is provided with an image forming apparatus including position determining member is provided in proximity to the image carrier. The compact image forming apparatus may be realized.

According to another aspect of the invention, there is provided with an image forming apparatus including an exposing device for forming a latent image every color with respect to the image carrier, and the paper using for secondary-transferring the toner image rushed into the intermediate transfer belt while a latent image of a final color is being formed by the exposing device.

According to another aspect of the invention, there is provided with an image forming apparatus including a paper which is used to secondary-transfer thereto the toner image rushes into the intermediate transfer belt while a toner image of a final color is being transferred onto the intermediate transfer belt at the primary transfer portion.

According to another aspect of the invention, there is provided with an image forming apparatus including the intermediate transfer belt is suspended on the image carrier by a plurality of members including the position determining member so as to form the primary transfer portion.

Since these structures are employed, the secondary transfer operation can be carried out within a short time after the primary transfer operation, so that the time duration required to form the image can be shortened. It should be understood that as to the operations/effects which have been explained in the respective aspects, although the individual explanations thereof are omitted so as to avoid duplicated descriptions, similar operations/effects may be expected from similar arrangements even in any aspects.

DESCRIPTION OF THE PREFERRED EMBODIMENTS

Referring now to accompanying drawings, embodiments of the present invention will be described.

Figure 1:
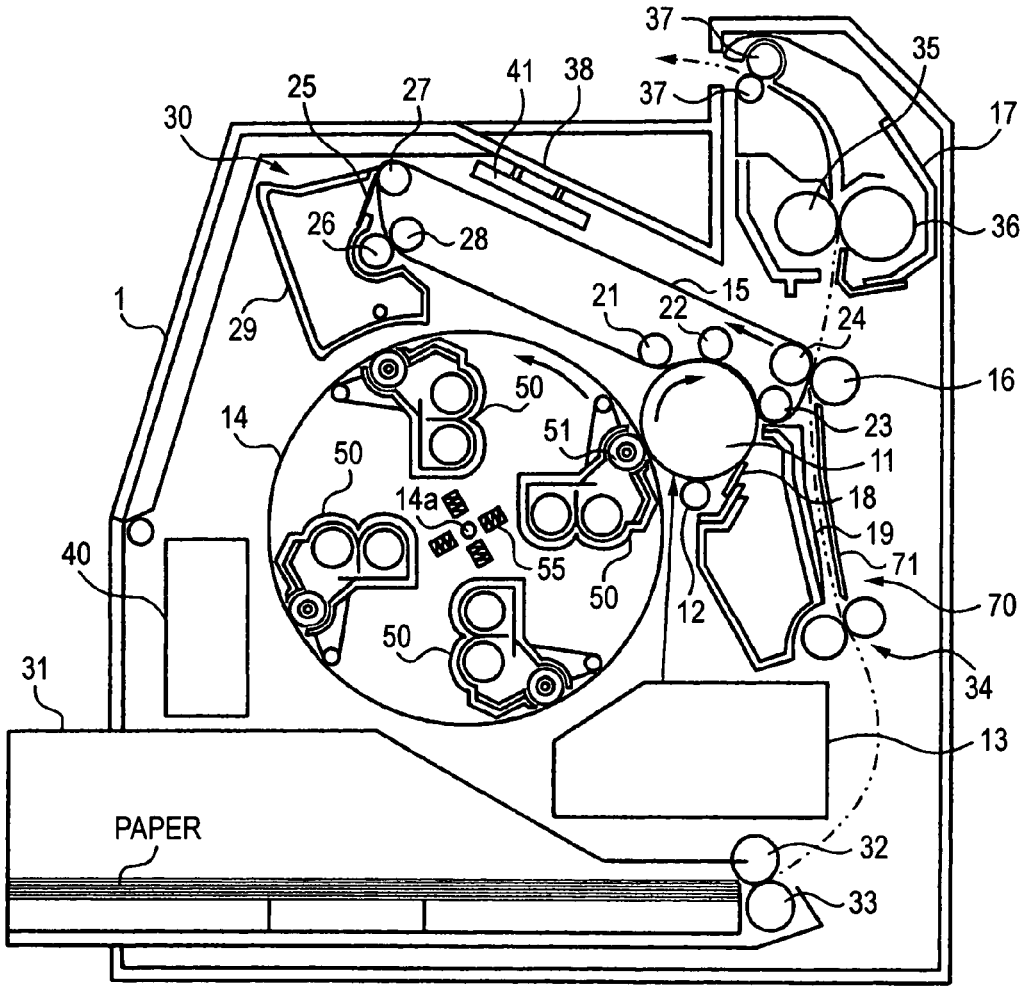
FIG. 1 is a diagram showing an entire construction of an image forming apparatus of the present invention.

FIG. 1 is a diagram for indicating an entire construction of an image forming apparatus of the present invention. FIG. 1 represents a digital color printer with employment of a rotary type developing apparatus. In the image forming apparatus shown in FIG. 1, a photosensitive drum 11, a charging device 12, an exposing apparatus 13, and a developing apparatus 14 are provided with respect to a main body 1. The photosensitive drum 11 corresponds to an image carrier which forms thereon an electrostatic latent image and carries a toner image. The charging device 12 applies electric charges to the photosensitive drum 11 by employing a charging roller and the like. The exposing apparatus 13 exposes the charged photosensitive drum 11 in response to an image signal derived from an image processing apparatus (IPS: Image Processing System) (not shown) by employing an ROS (Raster Output Scanner). The developing apparatus 14 develops the electrostatic latent image which has been formed on the photosensitive drum 11 by the exposing apparatus 13 so as to form a toner image.

This developing apparatus 14 corresponds to a rotary type developing apparatus equipped with four sets of developing devices 50. These four developing devices 50 include the respective color toners so as to form a toner image made of four colors, namely, a yellow(Y) color, a magenta(M) color, cyan(C) color, and a black(B) color. Developing rollers 51 for developing the photosensitive drum 11 are provided on a circumferential portion of the developing apparatus 14. Since the developing apparatus 14 is pivotally rotated every an angle of 90 degrees around a center 14*a* of the developing apparatus 14, the developing roller 51 employed in the desirable developing device 50 may be located opposite to the photosensitive drum 11. Concretely speaking, the Y, M, C, and K developing devices 50 are located opposite to the photosensitive drum 11 in this order with respect to one print output, so that a full color image can be developed. Also, the respective developing devices 50 are arranged in such a manner that these developing devices 50 are depressed on the normal by coil springs 55 arranged at the developing apparatus center 14*a*, and a tracking roller (will be explained later) provided for positioning operation can firmly abut against the photosensitive drum 11. The photosensitive drum 11 is pivotally rotated along an arrow direction (namely, clockwise direction) shown in this drawing, whereas the developing apparatus 14 is pivotally rotated along a counterclockwise direction in such a manner that the movement along the normal direction is made identical to the pivotal rotation (namely, clockwise direction) of the photosensitive drum 11.

An intermediate transfer belt 15, a secondary transfer roller 16, and a fixing apparatus 17 are provided on the downstream side of the developing apparatus 14 on the photosensitive drum 11. The intermediate transfer belt 15 corresponds to an intermediate transfer member which temporarily holds thereon a toner image which has been developed by the developing device 50 so as to be formed on the photosensitive drum 11. The secondary transfer roller 16 corresponds to a secondary transfer member. This secondary transfer member transfers to a paper, such a toner image which has been superimposed on the intermediate transfer belt 15 to be formed thereon. The fixing apparatus 17 heats and depresses the toner image formed on the paper so as to fix this toner image. Further, a cleaning blade 18, and a toner collecting bottle (toner collecting vessel) 19 are provided around the photosensitive drum 11. The cleaning blade 18 scrapes toners (remaining toners) left on the photosensitive drum 11 after a toner image has been primarily transferred to the intermediate transfer belt 15. The toner collecting bottle 19 collects the toners scraped by this cleaning blade 18 to store the collected toner into this toner collecting bottle 19. The intermediate transfer belt 15 is rotated 4 turns while one print image is formed. The intermediate transfer belt 15 is arranged as follows: That is, while the intermediate transfer belt 15 is rotated during first three rotating operations, namely while Y, M, and C toner images are held, the secondary transfer roller 16 is separated from the intermediate transfer belt 15, and then, when a last K-color toner image is superimposed on these Y, M, C-color toner images, this secondary transfer roller 16 is made in contact with the intermediate transfer belt 15.

The intermediate transfer belt 15 corresponds to an endless belt member made of an elastic material, and has a primary transfer device by way of a so-called "wrap transfer" operation. This primary transfer device is made in contact with (abutting) the photosensitive drum 11 in such a wrap form that this intermediate transfer belt 15 is wound around the photosensitive drum 11 only in a predetermined range. A thickness of this intermediate transfer belt 15 is, for instance, on the order of 0.5 mm, and a circumferential length thereof is equal to 443 mm. Either chloroprene having a superior oil-proofing characteristic and a superior weather-proofing characteristic or EPDM having a superior whether-proofing characteristic may be used to form the intermediate transfer belt 15. In this embodiment, a drive source is not provided with the intermediate transfer belt 15 itself. This intermediate transfer belt 15 is arranged in such a manner that this intermediate transfer belt 15 may follow rotations of the photosensitive drum 11 by utilizing a contact by the wrap transfer operation. The intermediate transfer belt 15 rotates along the counterclockwise direction in order that the rotation directions of the contact portions are made identical to each other.

A plurality of members (rollers) are provided inside the intermediate transfer belt 15 where a toner image is not held. A wrap-in roller 21, a primary transfer roller 22, and a wrap-out roller 23 are provided inside this intermediate transfer belt 15. The wrap-in roller 21 specifies a wrap position of the intermediate transfer belt 15 on the upstream side of the pivotal rotation in the photosensitive drum 11. The primary transfer roller 22 transfers a toner image formed on the photosensitive drum 11 onto the intermediate transfer belt 15. The wrap-out roller 23 specifies a wrap position of the intermediate transfer belt 15 on the downstream side of the wrap position. The intermediate transfer belt 15 is suspended over the photosensitive drum 11 by these rollers 21, 22, 23. A predetermined electric field is applied to the primary transfer roller 22 to assist the primary transfer operation. Also, both the wrap-in roller 21 and the wrap-out roller 23 are brought into either the GND state or a floating state.

Furthermore, a back-up roller 24 is provided inside the intermediate transfer belt 15 as a secondary transfer device to assist a secondary transfer operation executed by the secondary transfer roller 16. At a secondary transfer portion where the secondary transfer operation is carried out by both the secondary transfer roller 16 and the back-up roller 24, a predetermined potential difference is required between the back-up roller 24 and the secondary transfer roller 16. For instance, in the case that one roller, namely the secondary transfer roller 14 is biased at a high voltage, whereas the other roller, namely the back-up roller 24 is connected to the GND.

An intermediate transfer member cleaner 30 is provided on the downstream of the secondary transfer portion on the intermediate transfer belt 15. The intermediate transfer member cleaner 30 is provided as an intermediate transfer member cleaning device capable of removing remaining toners and paper powder on the intermediate transfer belt after the secondary transfer operation has been carried out. This intermediate transfer member cleaner 30 is equipped with a scraper 25, a brush roller 26, and a second toner collecting bottle 29. The scraper 25 scrapes toners left after the secondary transfer operation has been carried out. The brush roller 26 further scrapes toners left after the cleaning operation by the scraper 25 has been carried out. The second toner collecting bottle 29 collects the toners scraped by both the scraper 25 and the brush roller 26. A cleaning back-up roller 27, and another cleaning back-up roller 28 are provided inside the intermediate transfer belt 15. The cleaning back-up roller 27 assists the cleaning operation performed by this scraper 25. The cleaning back-up roller 28 assists the cleaning operation executed by the brush roller 26.

The scraper 25 is made of a thin plate having a thickness of approximately 0.1 mm, for example, stainless steel. A predetermined electric field is applied to this scraper 25. The brush roller 26 corresponds to a brush made of nylon and acrylic resin to which an electric-conductive treatment has been made. This scraper 25 is rotated by receiving drive force from a drive source, so that scraped toners are stored from a window formed in the second toner collecting bottle 29 into this second toner collecting bottle 29. Both the scraper 25 and the brush roller 26 scrape the remaining toners which are left on the intermediate transfer belt 15 after the secondary transfer roller 16 is made in contact with the intermediate transfer belt 15 so as to perform the secondary transfer operation. To this end, it is so arranged that while both the scraper 25 and the brush roller 26 are separated from the intermediate transfer belt 15 in the beginning stage of the image forming operation in order that the toner images which are being superimposed with each other are not scraped. The scraper 25 and the brush roller 26 are contacted to the intermediate transfer belt 15 in an integral form at predetermined timing.

As shown in FIG. 1, in this embodiment, the intermediate transfer belt 15 becomes relatively narrow and long. This intermediate transfer belt 15 is supported under a flat condition by the wrap-in roller 21, the wrap-out roller 23, the back-up roller 24, the cleaning back-up roller 27, the cleaning back-up roller 28, and the like. Then, the secondary transfer portion against which the intermediate transfer roller 16 abuts is provided at one edge of this flat-supported intermediate transfer belt 15 along the longitudinal direction, whereas the intermediate transfer member cleaner 30 is arranged at the other edge of this belt 15 along the longitudinal direction. Then, the secondary transfer portion against which the secondary transfer roller 16 abuts is provided in the vicinity of such a position that the intermediate transfer belt 15 abuts with respect to the photosensitive drum 11 in the wrap form. In other words, the photosensitive drum 11 is arranged at such a position which is located closes to the secondary transfer portion against which the secondary transfer roller abuts, rather than the position where the intermediate transfer cleaner 30 is provided. As previously explained, in this embodiment, the image forming apparatus using the intermediate transfer belt 15 which is pivotally rotated every each color employs such a layout that the secondary transfer portion is provided in the vicinity of the position just after the primary transfer portion against which both the photosensitive drum 11 and the intermediate transfer belt 15 abut in the wrap form.

As a paper transporting system, a paper supply cassette 31, a feed roller 32, a retard roller 33, a register roller 34, a heat roller 35, a pressure roller 36, an ejection roller 37, and an ejection tray 38 are provided. The paper supply cassette 31 stores thereinto various sorts of transfer materials such as papers and OHP sheets. The feed roller 32 derives papers from the Paper cassette 31 to supply the derived papers. The retard roller 33 smoothly separates the supplied papers one by one. The register roller 34 performs a positioning registration by controlling timing as to a transfer operation with respect to a paper which has been transported from the paper supply cassette 31 via the feed roller 32 and the like. The heat roller 35 is provided in the fixing apparatus 17, and is used to heat a toner image formed on a paper. The pressure roller 35 is provided opposite to the heat roller 35, and depresses paper when a toner image is heated. The ejection roller 37 ejects a paper out from the image forming apparatus after a toner image has been fixed. The ejection tray 38 is provided at an upper unit of the image forming apparatus, and stacks papers which are ejected from the ejection roller 37.

As shown in FIG. 1, a paper transport path 70 is provided as a paper transport path in a longitudinal direction. This paper transport path 70 has a transport guide 71 provided in this image forming apparatus, and an outer wall of the toner collecting bottle 19 corresponding to a box body.

In other words, in this embodiment, one plane of the paper transport path 70 is formed by the outer wall of the toner collecting bottle 19, and the other plane of this paper transport path 70 is formed by the transport guide 71, while this paper transport path 70 is provided between the register roller 34 and the secondary transfer portion, and transports papers from the lower portion toward the upper portion along a substantially vertical direction.

Furthermore, the image forming apparatus has a control unit 40 and a position sensor 41. The control unit 40 controls the respective members of this image forming apparatus. The position sensor 41 is provided adjacent to the intermediate transfer belt 15, and corresponds to a reflection type photosensor which senses a patch of a toner formed on the intermediate transfer belt 15. This position sensor 41 is capable of sensing a position of the intermediate transfer belt 41 along the rotation direction by reading a patch formed on the intermediate transfer belt 15 along the longitudinal direction. Concretely speaking, since exposing operations are performed at pre-selected timing from such a plane that the patch was sensed by the position sensor 41, Y, M, C, and K-color toner images are positioned. Also, concentration of a toner formed on the intermediate transfer belt 15 is sensed based upon the sensor output of this position sensor 41, and concentration control operation may be carried out by the control unit 40 based upon this concentration sensing result.

Next, an image forming process operation will be explained by referring FIG. 1. The image forming apparatus receives an output request issued from either a PC (personal computer) or an image reading apparatus (IIT), which are externally connected to this image forming apparatus, and commences an image forming process operation based upon an instruction supplied from the control unit 40. In the case of a full color print output, the developing apparatus 14 is firstly and pivotally rotated in such a manner that the yellow(Y)-color developing device 50 is located opposite to the photosensitive drum 11. First of all, when a yellow-color toner image is formed, the photosensitive drum 11 rotating along the clockwise direction is charged by the charging unit 12 using in an electric charge forming process. Thereafter, an exposing operation is carried out based upon image information corresponding to the yellow color by using, for example, laser light emitted from the exposing apparatus 13 in the exposing device, so that an electrostatic latent image is formed. Next, after a developing operation has been carried out by the developing roller 51, a yellow toner image is transferred onto the intermediate transfer belt 15 within a wrap-shaped contact range (wrap range). At this time, the secondary transfer roller 16, the scraper 25, and the brush roller 26 are retracted (separated) from the intermediate transfer belt 15, so that the toner image transferred onto the intermediate transfer belt 15 is not scraped by these secondary transfer roller 16, scraper 25, and brush roller 26.

As to the surface of the photosensitive drum 11 where the primary transfer operation of the yellow toner image has been accomplished, the toner left on this surface is scraped by the cleaning blade 18. This cleaned surface is moved to the charging unit of the charging device 12 for forming a next toner image. The remaining toner which has been scraped by this cleaning blade 18 is stored in the toner collecting bottle 19. The developing apparatus 14 is pivotally rotated in order to be matched to the timing of the developing operation, so that the magenta-color developing device 50 is located opposite to the photosensitive drum 11. A magenta-color toner image is sequentially formed from an electrostatic latent image which has been exposed by the exposing apparatus 13 based upon magenta image information, and then, this magenta-color toner image is superimposed on the intermediate transfer belt 15. A cyan-color toner image and a black-color toner image are sequentially superimposed on the intermediate transfer belt 15 in a similar manner, and then, the primary transfer operation is accomplished.

The secondary transfer roller 16 is advanced (extrude) with respect to the intermediate transfer belt 15 at such a time instant that the primary transfer operation with respect to the cyan-color toner image by the exposing apparatus 13 is accomplished and before an exposing operation (exposing operation for black color image) used to form a black-color electrostatic latent image is commenced in an inter image after the toner image to which the cyan-color toner image has been superimposed has passed through the secondary transfer portion (namely, place where secondary transfer operation is carried out by secondary transfer roller 16), and then is prepared for a secondary transfer operation under such a condition that the secondary transfer roller 16 abuts (contacts) against the intermediate transfer belt 15. After the black-color exposing operation has been accomplished, when the cleaner portion (namely, place where cleaning operation is carried out by scraper 24 and brush roller 26) is the inter image, both the scraper 25 and the brush roller 26 are advanced with respect to the intermediate transfer belt 15. This inter image may be regarded as such an area portion that a toner image is not formed on either the intermediate transfer belt 15 or the photosensitive drum 11 (namely, forming of toner image is not scheduled), and/or may be regarded as such a portion that a writing operation by exposure is not scheduled.

The feed roller 32 is driven at the predetermined timing under by the control unit 40, so that the papers are successively derived from the paper supply cassette 31, and also are smoothly separated one by one by the retard roller 33 to be reached to the register roller 34. The register roller 34 is rotated by being matched to the timing of the secondary transfer operation in the secondary transfer portion, and may function in such a manner that the paper is fed out to the secondary transfer portion at the predetermined timing. In this embodiment, as previously explained, while the surface (outer wall) of the toner collecting bottle 19 is employed as the paper transport path 70, the papers are transported by utilizing the paper transport path 70 with employment of both the surface (outer wall) of the toner collecting bottle 19 and the transport guide 71. As explained above, the papers stored in the paper supply cassette 31 are transported by the transporting apparatus along the substantially vertical direction, and are transported to the secondary transfer portion by both the secondary transfer roller 16 and the back-up roller 24, in which the toner images are transferred to the papers. Since the secondary transfer operation can be carried out by such a transport path along the vertical direction and also the length of the paper transport path is made very short, total cost can be reduced by decreasing a total number of structural elements. Furthermore, reliability with respect to the paper transporting operation can be improved.

The paper to which the toner image has been transferred in the secondary transfer portion is transported to the fixing apparatus 17. In the fixing apparatus 17, the toner image formed on the paper is heated by the heat roller 35, and depressed to the paper by the pressure roller 36 so as to be fixed on this paper. Thereafter, this paper on which the toner image has been fixed is outputted via the ejection roller 37 outside the image forming apparatus, and is then stored into the ejection tray 38 provided in the upper portion of the main body 1. The image forming process executed when one sheet of color print is outputted is ended in accordance with the above-explained manner. As previously explained, in this embodiment, while the intermediate transfer belt 15 having the relatively narrow and flat-shaped layout is employed, the secondary transfer operation is carried out by transporting the paper along the longitudinal path, so that the size of the main body 1 can be made very small.

Next, constructions as to the photosensitive drum 11, the developing apparatus 14, and the intermediate transfer belt 15 will now be described in detail.

Figure 2:
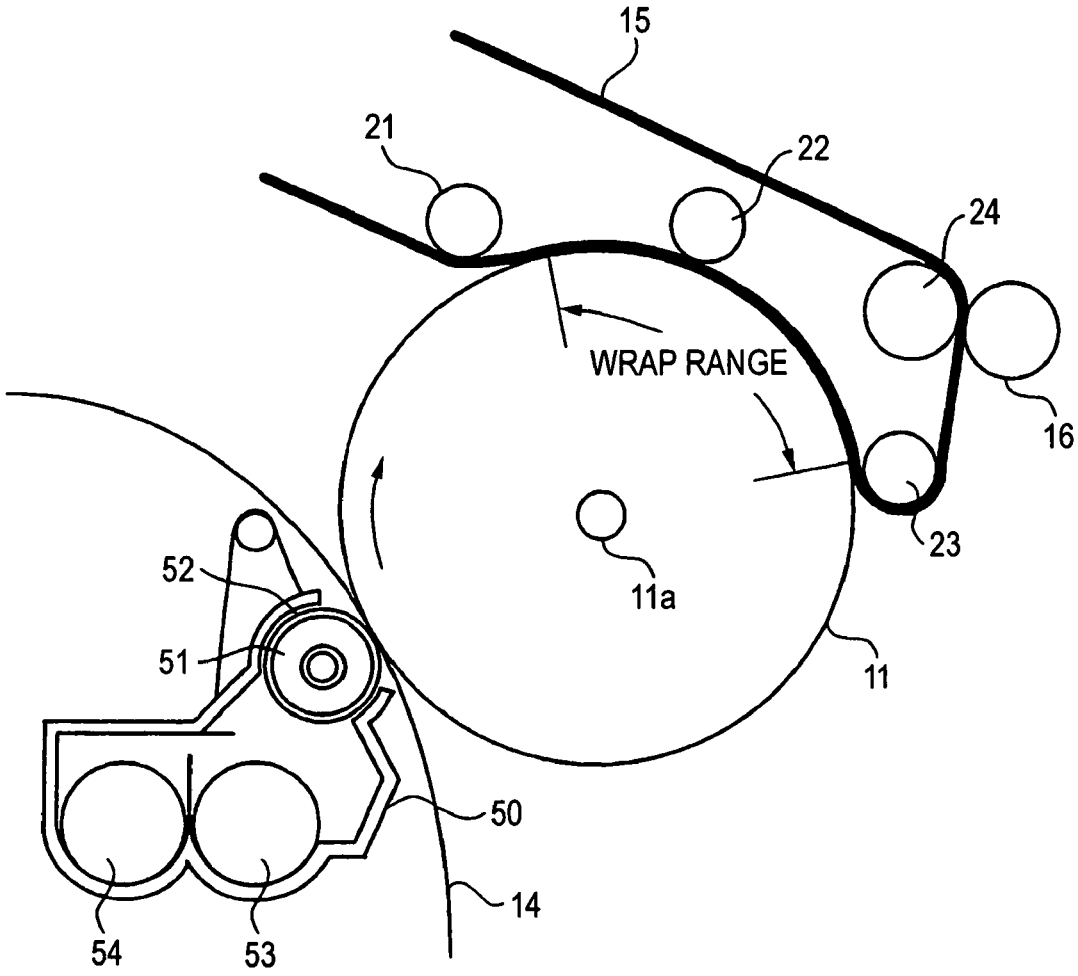
FIG. 2 is an explanatory diagram explaining a relationship among a photosensitive drum, a developing apparatus, and an intermediate transfer belt.

FIG. 2 is an explanatory diagram for explaining a relationship among the photosensitive drum 11, the developing apparatus 14, and the intermediate transfer belt 15. The photosensitive drum 11 corresponds to a pipe-shaped member having a diameter of approximately 47 mm. A photosensitive layer is formed on a surface of an aluminum pipe, and the photosensitive drum 11 receives drive force of a motor (not shown) from a shaft 11*a* of a center portion via flanges (not shown) which are made of aluminum and are provided on both ends of this aluminum pipe. For example, in such a case that an A4-sized color image having a length of 297 mm along the longitudinal direction is printed out at a speed of 5 sheets per 1 minute (5 ppm), 20 images (namely, 4-color images×5 sheets) must be formed on the photosensitive drum 11 per 1 minute. The photosensitive drum 11 is arranged in such a manner that this photosensitive drum 11 is rotated by 3 turns so as to form one image, namely, is rotated at a speed of approximately 150 mm/sec, 1 turn per 1 minute. In order to mitigate a color shift caused by an eccentricity and the like of the photosensitive drum 11, the forming positions of the respective images formed on the photosensitive drum 11 are desirably formed at the same places.

Each of the four-color (Y, M, C, K) developing devices 50 is provided with a developing roller 51, a tracking roller 52, a supply anger 53, and an admix auger 54. The developing roller 51 corresponds to a developer carrier which carries a developer (developing agent). The tracking roller 52 corresponds to a positioning member which is used to keep a distance constant between the developing roller 51 and the photosensitive drum 11. The supply auger 53 and the admix auger 54 stir developers supplied to the developing roller 51. The developing roller 51 is made of, for example a pipe-shaped member having a diameter of 16 mm. Carriers contained in the developer are attracted by magnetic force produced by a magnet roller (not shown) arranged inside this developing roller 51, a magnetic brush of the developer is formed on the surface of this developing roller 51, and toners attracted to the carriers are transported to the developing area of the photosensitive drum 11. Since a tip portion of this magnetic brush formed in the above-explained manner is made in contact to the surface of the photosensitive drum 11 so as to develop an electrostatic latent image, the distance between the photosensitive drum 11 and the developing roller 51 is continuously maintained in a certain constant interval.

The tracking rollers 52 each having a slightly larger diameter than the diameter of the developing roller 51 are provided on both edge portions (namely, both In-side and Out-side of image forming apparatus, or both right side and left side thereof) of the developing roller 51 in such a manner that these tracking rollers 52 are coaxially provided with respect to this developing roller 51. The slightly larger diameter of this tracking roller 52 is selected to be 0.3 mm. For instance, assuming now that the diameter of the developing roller 51 is selected to be ". 16" mm, the diameter of the tracking roller 52 becomes ". 16.6" mm. The tracking roller 52 is made of synthetic resin such as polyacetal. The tracking rollers are employed in four sets of the developing devices of the developing apparatus 14. While the four developing devices 50 are selectively switched, the developing apparatus 14 causes a desirable developing roller 51 to be located opposite to the photosensitive drum 11 at a rotation speed of 90 degrees per 0.7 seconds. While the tracking rollers 52 are drawing an orbit over the circumferential portion, the tracking rollers 52 abut against the photosensitive drum 11 at the same time that shock may be reduced by receiving predetermined elastic force exerted by the coil springs 55 shown in FIG. 1.

The intermediate transfer belt 15 corresponding to the intermediate transfer member having elasticity is made in contact to the photosensitive drum 11 by both the wrap-in roller 21 and the wrap-out roller 23 in such a manner that this intermediate transfer belt 15 covers the photosensitive drum 11 with respect to such a wrap range as shown in FIG. 2.

The wrap-in roller 21 and the wrap-out roller 23 are not made in contact with the photosensitive drum 11, but both of the rollers 21, 23 are provided in proximity to each other, so that the rollers 21, 23 can avoid that the intermediate transfer belt 15 is sandwiched due to fluctuations of the photosensitive drum 11 and the like in order to suppress damages given to the intermediate transfer belt 15.

The wrap range (namely, contact range in wrapping state) as shown in FIG. 2 corresponds to an arc range which is formed at an angle of approximately 90 degrees on a circumferential portion of the photosensitive drum 11. Since this intermediate transfer belt 15 is an elastic belt, this elastic intermediate transfer belt 15 depresses the photosensitive drum 11 by relatively heavy weight. More specifically, in this embodiment, while the drive force is not applied to the intermediate transfer belt 15 itself, the intermediate transfer belt 15 is arranged in such a manner that the intermediate transfer belt 15 may follow the photosensitive drum 11 by receiving the drive force of this photosensitive drum 11.

In this embodiment, the wrap-out roller 23 is provided between the wrap range and the second transfer portion. The wrap-out roller 23 is a tension roller for applying predetermined tension with respect to the intermediate transfer belt 15. The wrap range is the primary transfer device which made by the intermediate transfer belt 15. The second transfer portion is the secondary transfer device. So, the wrap-out roller 23 may function as a position determining device (position determining member) for determining a position between this primary transfer device and the secondary transfer device. The above-described secondary transfer portion is defined by an abutting portion between the secondary transfer roller 16 and the intermediate transfer belt 15, and an opposite portion between the secondary transfer roller 16 and the back-up roller 24.

Figure 3:
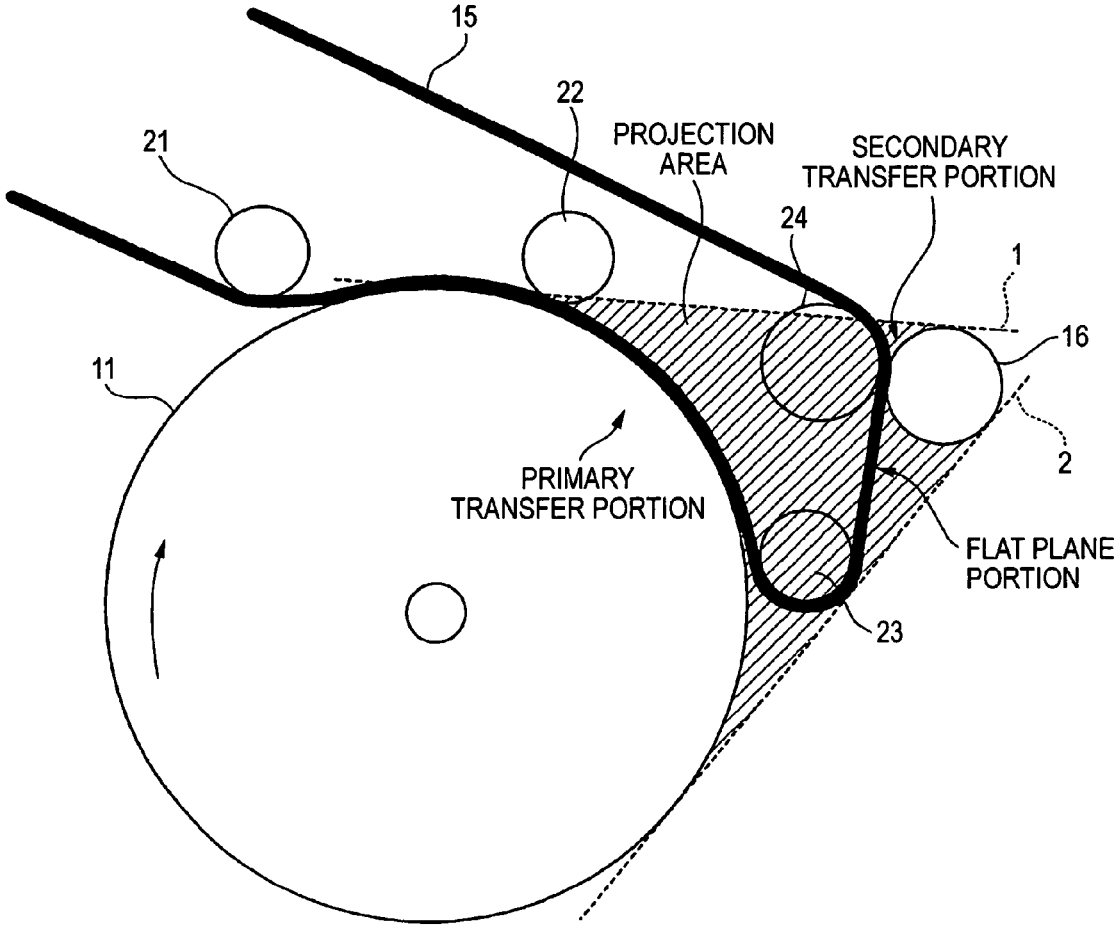
FIG. 3 is an explanatory diagram explaining an arranging position of a wrap-out roller.

FIG. 3 is an explanatory diagram for explaining an arranging position of the wrap-out roller 23. As previously explained, in this embodiment, in order to determine a position between the primary transfer device and the secondary transfer device, the wrap-out roller 23 is arranged between the position (primary transfer portion where the intermediate transfer belt 15 abuts against the photosensitive drum 11 in the wrap shape and the position (secondary transfer portion) where the intermediate transfer belt 15 abuts against the secondary transfer roller 16 so as to tense the intermediate transfer belt 15. The wrap-out roller 23 corresponding to the tension roller is arranged together with the wrap-in roller 21 in proximity to the photosensitive drum 11 corresponding to the image carrier, and depresses the intermediate transfer belt 15 to the photosensitive drum 11. In other words, the intermediate transfer belt 15 is suspended on the photosensitive drum 11 by the wrap-in roller 21, the primary transfer roller 22, and the wrap-out roller 23, so that the wrap-shaped contact can be established by the intermediate transfer belt 15. Since the intermediate transfer belt 15 is contacted to the photosensitive drum 11 in the wrap-shaped form so as to perform the primary transfer operation, a paper to which a toner image is transferred is transported, and thus, even when a tip portion of this paper is contacted to the intermediate transfer belt 15, shock occurred when the paper images can be absorbed. Therefore, disturbance of images caused by this shock during the primary transfer operation can be suppressed.

On the other hand, the wrap-out roller 23 suspends the intermediate transfer belt 15 between the own wrap-out roller 23 and the back-up roller 24 in the straight form, and thus, a flat plane portion is formed by the intermediate transfer belt 15 between this wrap-out roller 23 and the secondary transfer portion. As will be explained later, this flat plane portion can cause the paper to be entered into the secondary transfer portion in a smooth manner, and can realize that the tip portion of the paper is not made in contact with the intermediate transfer belt 15 until the secondary transfer portion corresponding to the secondary transfer point, so that the paper tip portion can contribute an improvement of the paper transporting characteristic.

As explained above, in this embodiment, since both the primary transfer portion and the secondly transfer portion are formed by sandwiching the wrap-out roller 23 corresponding to the tension roller, the distance defined from the primary transfer position (namely position of primary transfer portion) up to the secondary transfer position (namely, position of secondary transfer portion) can be constructed by a short distance. As a result, when the Y, M, C, K-color toner images are sequentially primary-transferred so as to be superimposed on the intermediate transfer belt 15 and then the superimposed toner image is transferred (secondary-transferred) onto the paper, as will be explained later, while the toner image of the k-color corresponding to the last color is being primary-transferred, the secondary transfer operation 16 can be carried out, so that the time required to output the paper, namely so-called "throughput" can be shortened.

This construction in which the distance defined from the primary transfer position up to the secondary transfer position is made shorter can be realized by that the secondary transfer device is provided in such a manner that this secondary transfer device is located in proximity to the downstream side of the intermediate transfer belt 15 along the pivotal rotation direction with respect to the primary transfer device. When this construction is grasped in an illustrative manner, the following construction is given. That is, the wrap-out roller 23 corresponding to the tension roller is arranged within a projection area which is directed to the photosensitive drum 11 for constituting the primary transfer device. In FIG. 3, as the projection area, a hatched line portion is represented. In other words, such a range is indicated which is surrounded by tangential lines (tangential line 1 and tangential line 2) for connecting both the secondary transfer roller 16 and the photosensitive drum 11. Since the tension roller is arranged within the range which is surrounded by this projection area, it can be realized that the time required for outputting the paper, namely so-called "throughput" can be shortened. Also, if the position of the tension roller is arbitrarily set within the projection area, then the throughput can be shortened, the paper transport characteristic can be improved, and the transfer efficiency can be improved. Although there are some cases that the wrap-out roller 23 cannot be completely entered within this projection area depending upon the dimensions as to the photosensitive drum 11, the secondary transfer roller 16, and the wrap-out roller 23, if the structural portion of the wrap-out roller 23 is arranged in such a portion which is slightly entered even inside this projection area, then it is desirable as to such a technical point that the throughput can be shortened and the paper transport performance can be improved.

Next, a description is made of a transport path through which a paper is transported to the secondary transfer port.

Figure 4:
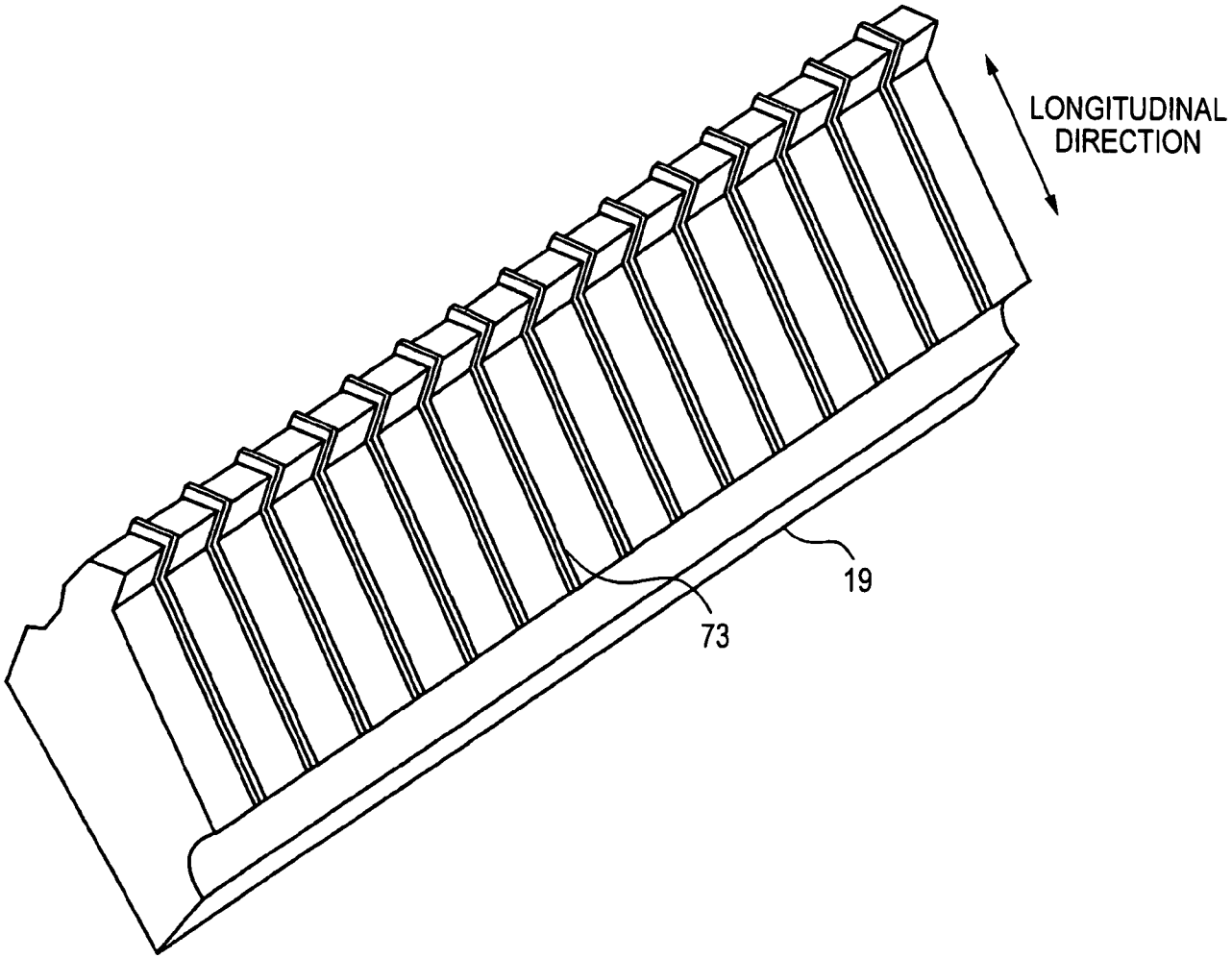
FIG. 4 is a diagram showing an outer view of a toner collecting bottle.

FIG. 4 is a diagram for indicating an outer view of the toner collecting bottle 19. As indicated in FIG. 4, a plurality of ribs are provided on an outer wall of a vessel in the toner collecting bottle 19 along a longitudinal direction of the vessel. When the toner collecting bottle 19 is mounted on the main body 1 of the image forming apparatus, the longitudinal direction thereof constitutes the paper transport path 70 elongated along the substantially vertical direction, and the vessel of the toner collecting bottle 19 becomes a box-shape elongated along the longitudinal direction. The remaining toners which have been scraped by the cleaning blade 18 provided at an upper portion of the longitudinal portion are sequentially stored from a lower portion of the longitudinal portion. Since the toner collecting bottle 19 is arranged along the longitudinal direction, the disposed toners which have been scraped are stored into the box due to the own weight, so that the disposed toners can be smoothly stored, and also, such a problem as a toner leakage can hardly occur.

The toner collecting bottle 19 forms one plane of the paper transport path 70 which transports the paper from the lower portion along the substantially vertical direction, corresponding to the upstream side of the transport path, toward the upper potion corresponding to the downstream side of the transport path. On this one plane, a plurality of ribs 73 are formed from the upstream side to the downstream side. The vessel of the toner collecting bottle 19 is made of, for example, ABS (acrylonitrile-butadiene-styrene copolymer), whereas the ribs 73 are molded with the external wall of this vessel in an integral form. As a result, the dimensional precision of the ribs 73 can be readily established, and also, a total number of structural members can be reduced. As previously explained, since the guide portion provided on the external wall of the toner collecting bottle 19 is provided in front of the secondary transfer portion, the toner collecting bottle 19 which occupies a relatively large space can be utilized as the transport path. As a result, the entire image forming apparatus can be made compact.

Figure 5:
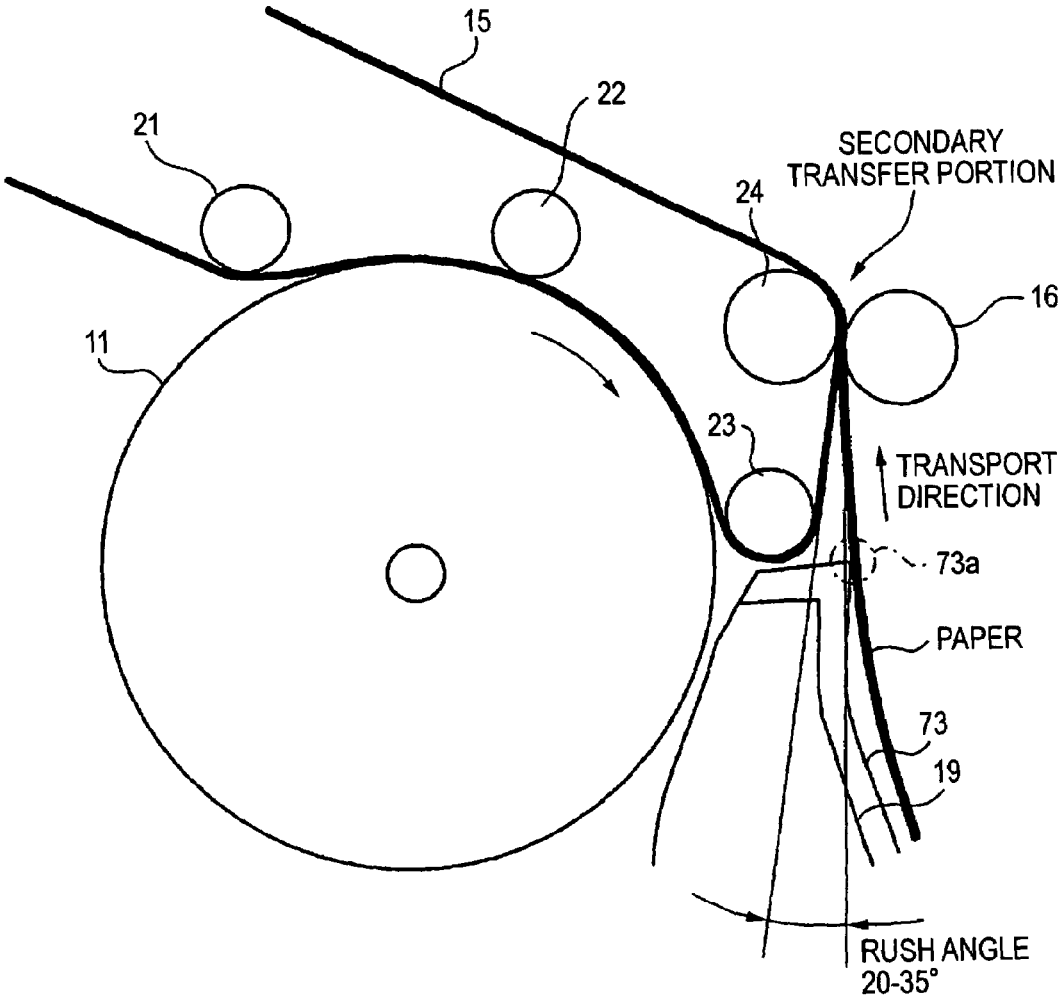
FIG. 5 is an explanatory diagram explaining such a condition that a paper guided by ribs formed on the toner collecting bottle rushes into a secondary transfer portion.

FIG. 5 is an explanatory diagram for explaining a rush condition of a paper into the secondary transfer portion, which is guided by the ribs 73 provided on the toner collecting bottle 19. The paper which is transported along a transport direction indicated by an arrow shown in this drawing abuts against the flat plane portion (namely, portion between wrap-out roller 23 and backup roller 24) of the intermediate transfer belt 15 at a predetermined rush angle. When this paper is entered, the tip portion of the paper is not contacted to the intermediate transfer belt 15 up to the secondary transfer portion constituting a point of the secondary transfer operation, and furthermore, when the tip portion of the paper rushes in to the secondary transfer portion, shocks of this rushing operation should be relaxed as being permitted as possible. With respect to the adverse influences caused by transporting the paper, Inventors of the present invention repeatedly performed the experiments and could find out such a fact. That is, in the case that the rush angle at which the paper rushed (entered) into the flat plane portion of the intermediate transfer belt 15 was smaller than, or equal to 20 degrees, the plane of this paper was made in contact with the intermediate transfer belt 15 before the secondary transfer portion, so that an occurrence of image blurring phenomenon known as a so-called "smear" could be found out. Also, in the case that the rush angle exceeded 45 degrees, and was selected to be, for example, 50 degrees and 60 degrees, the tip portion of the paper was strongly contacted to the intermediate transfer belt 15, so that the images were disturbed due to shock vibrations, and the toners were scattered. In this embodiment, generally speaking, the intermediate transfer belt 15 abuts against the photosensitive drum 11 in the wrap shape, and the primary transfer operation employs a so-termed "wrap transfer operation", and therefore, there is no specific problem as to the shocks caused by that the paper rushes into the flat plane portion of the intermediate transfer belt 15. However, in the case that such a special paper as a thicker paper and an OHP paper is especially transported, if the rush angle exceeds 45 degrees, then the image is disturbed with respect to this shock. More specifically, in this embodiment, the image forming apparatus is made compact, and thus, the primary transfer portion is located in proximity to the secondary transfer portion. In the case that the paper is transported under this condition, there is a risk that when the latent image is formed on the photosensitive drum 11 located close to the intermediate transfer belt 15, the image is disturbed due to rushing of the paper.

As a consequence, as a result of deep investigation made by Inventors, the following conclusions could be obtained. That is, in the case that a paper (transfer material) having normal hardness is transported, the rush angle thereof is preferably selected to be larger than, or equal to 20 degrees, and smaller than, or equal to 45 degrees. Furthermore, in the case that a paper such as a thicker paper is transported, the rush angle thereof is especially desirable to be set larger than or equal to 20 degrees and smaller than, or equal to 35 degrees. In this embodiment, under such a condition, the flat plane portion was provided in the intermediate transfer belt 15 before the secondary transfer portion, which was inclined with respect to the paper transport path 70 at a predetermined angle, and the shapes of the ribs 73 of the toner collecting bottle 19 corresponding to the toner collecting vessel was properly designed in order that the paper may rush within the above-described range. Concretely speaking, the paper which is transported through the paper transport path 70 abuts against a predetermined portion of the transport guide 71 shown in FIG. 1, and thereafter, abuts against the tip portion 73*a* of the rib 73. The attitude of the paper which abuts against this tip portion 73*a* is maintained by the hardness of this paper, and then rushes into the secondary transfer portion. At this time, in order that the attitude maintaining function due to the hardness of the paper may become effective, it is desirable to arrange these members in such a manner that an arc is slightly drawn in a direction along which this paper is separated apart from the intermediate transfer belt 15. Since the image forming apparatus is arranged in the above-described manner, the shock can be relaxed and the image disturbance caused by transporting the paper can be suppressed.

Next, a description is made of operation timing of the secondary transfer roller 16 and the like to which this embodiment is applied.

Figure 6:
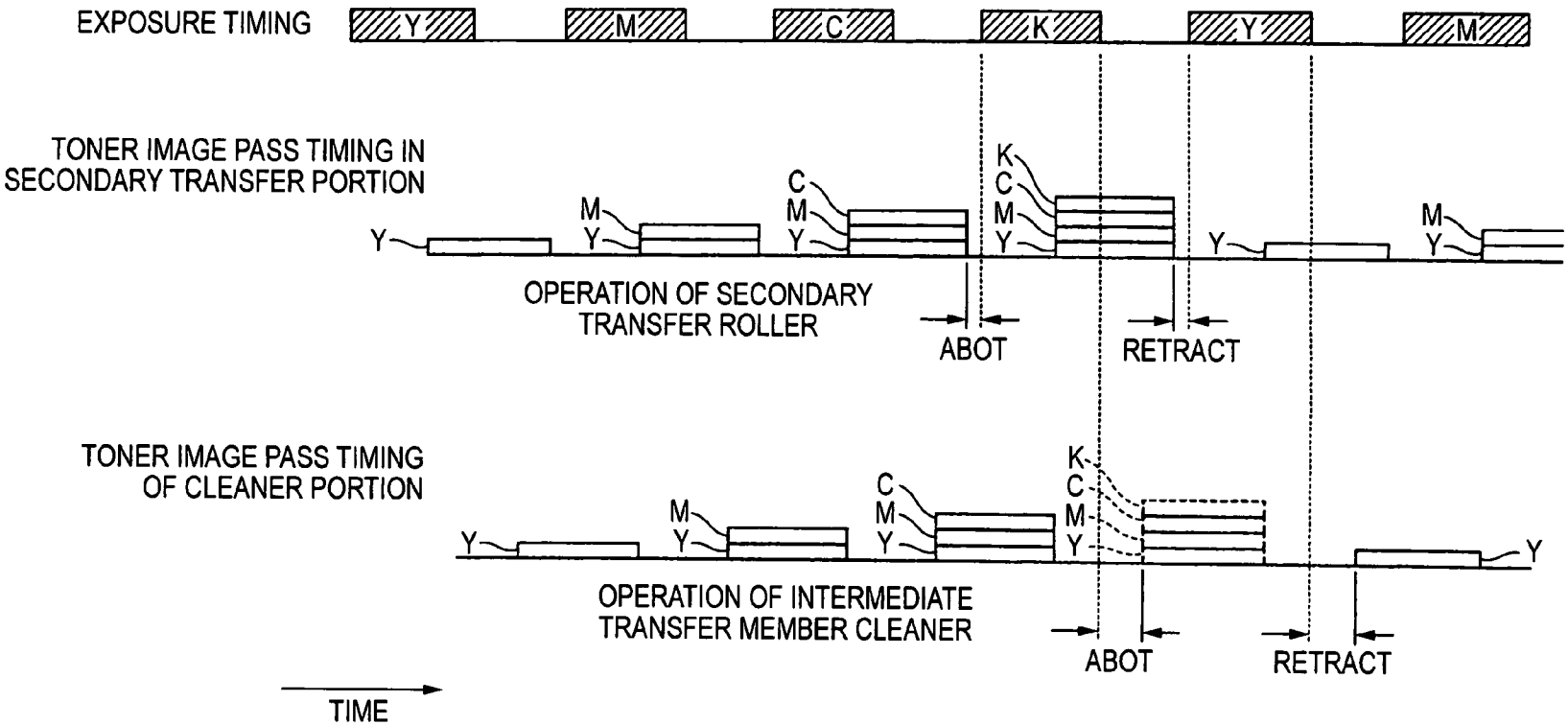
FIG. 6 is a diagram showing a timing relationship between exposure timing and operations as to both a secondary transfer roller and an intermediate transfer member cleaner.

FIG. 6 is a diagram for representing a timing relationship between exposure timing and operations of both the secondary transfer roller 16 and the intermediate transfer cleaner 30. The respective operations are controlled by the control unit 40 shown in FIG. 1. In this timing relationship, these relationships are indicated along a time lapse from a left side to a right side. In the exposure timing shown in the upper stage, the exposing operations for 1 print are firstly carried out by the exposing apparatus 13 in this order of Y (yellow), M (magenta), C (cyan), and K (black)-color image forming operations. Thereafter, Y-color exposing operation, M-color exposing operation, - - -, K-color exposing operation with respect to a next print are sequentially carried out. First, a Y-color toner image is once held on the intermediate transfer belt 15. In the next time period, an M-color toner image is superimposed on this Y-color toner image. Similarly, a C-color toner image, and a K-color toner image are superimposed on above-described toner image. In the secondary transfer portion where the secondary transfer operation is carried out by the secondary transfer roller 16, the toner image held on the intermediate transfer belt 15 passes therethrough at such a timing shown in a middle stage of FIG. 6. Also, in the cleaner portion against which the intermediate transfer member cleaner 30 abuts, the toner image held on the intermediate transfer belt 15 passes therethrough at such a timing shown in a lower stage of FIG. 6.

The secondary transfer roller 16 is extruded (advanced) toward the intermediate transfer belt 15, and abuts (is contacted) against this intermediate transfer belt 15 at such a timing between the cyan (C)-color exposing operation and the black (K)-color exposing operation before all of the Y, M, C, K-color exposing operations with respect to 1 print are accomplished, and furthermore, after the toner image has passed through the secondary transfer portion. In other words, before the last color (e.g., K) for 1 print is exposed (namely, after color (e.g., C) preceding to last color has been exposed), at such a timing after the toner image (e.g., Y, M, C-color toner images) has passed through the secondary transfer portion, the secondary transfer roller 16 abuts against the intermediate transfer belt 15, while the colors up to the color (e.g., C) preceding to this final color (e.g., K) have been superimposed on this toner image. Also, the secondary transfer roller 16 is separated (retracted) from the intermediate transfer belt 15 after all of the. Y, M, C, K-color exposing operations for 1 print have been accomplished, before a yellow (Y)-color exposing operation, namely, a first color (head color) of a next print is commenced, and furthermore, after such a toner image to which all of the colors have been superimposed has passed through the secondary transfer portion (namely, after secondary transfer operation has been ended with respect to paper).

Since the contact/retract operations of the secondary transfer roller 16 is controlled at the above-described timing by the control unit 40, even in such a case that the layout where the primary transfer portion is located in proximity to the secondary transfer operation is employed, and also, the image having the size of the maximum length along the paper transport direction is formed, the shock and the vibration caused by the contact/retract operations of the secondary transfer roller 16 during the exposing operation are not transferred to the exposing device, and the image disturbance occurred when the image is written can be suppressed, because the second transfer roller 16 is not contacted/retracted during the exposing operation. Also, in the case that the next print is not present after all of the Y, M, C, K-color exposing operations for 1 print have been accomplished, the secondary transfer roller 16 is not immediately separated (retracted) from the intermediate transfer belt 15, but is directly continued to abut against the intermediate transfer belt 15. Alternatively, the unwanted toners which are adhered to the surface of the second transfer roller 16 may be cleaned by applying both a positive-polarity bias and a negative-polarity bias to the secondary transfer roller 16.

It should be understood that the timing when the paper reaches the secondary transfer portion is made coincident with such a timing that the secondary transfer roller 16 abuts against the intermediate transfer belt 15, and thereafter, the toner image to which the four colors (Y, M, C, K) of toner images have been superimposed passes through he secondary transfer portion in a middle stage of FIG. 6. When exposure timing (shown in upper stage of FIG. 6) of the exposing apparatus 13 is viewed, the black (K) color is being exposed which corresponds to the last color. Also, this timing corresponds to such an operation that the K-color toner image is carried on the photosensitive drum 11, and the primary transfer operation is being carried out in the primary transfer portion. In the case that the secondary transfer portion is arranged in proximity to the primary transfer portion, there is a certain risk that the vibration caused by that the paper rushes into the intermediate transfer belt 15 gives an adverse influence to both the exposing apparatus 13 and the primary transfer operation. However, in this embodiment, the wrap-out roller 23 corresponding to the tension roller is properly arranged, for example, the intermediate transfer belt 15 corresponding to the elastic member is employed, and this intermediate transfer belt 15 abuts against the photosensitive drum 11 in the wrap form, so that the image disturbance occurred when the paper rushes into the intermediate transfer belt 15 may be suppressed.

As previously described in detail, in accordance with this embodiment, since both the primary transfer portion and the secondary transfer portion are formed by sandwiching one tension roller (namely, wrap-out roller 23), the distance defined from the primary transfer position up to the secondary transfer position can be constructed as a short distance, and the throughput can be shortened, and also, the image forming apparatus can be made compact. Also, the entering angle of the paper is selected to be smaller than, or equal to 45 degrees, or is more preferably selected to be larger than, or equal to 20 degrees and smaller than, or equal to 35 degrees, so that the paper can be smoothly entered into the secondary transfer position. Furthermore, since the intermediate transfer belt 15 is constituted by the endless belt member having the elasticity, the shock and the speed variation can be relaxed which are caused by that the paper rushes into the secondary transfer position. Also, in the primary transfer portion, it is so arranged that the intermediate transfer belt 15 is wound on the photosensitive drum 11 over a predetermined wrap range (area). As a result, the shock and the speed variation can be relaxed which are caused by that the paper rushes into the intermediate transfer belt 15, and further, the transfer efficiency can be improved.

EFFECT OF THE INVENTION

As previously described, in accordance with the present invention, the primary transfer position is arranged in proximity to the secondary transfer position, so that the image forming apparatus can be made compact.

What is claimed is:

1. An image forming apparatus comprising:

primary transferring device for transferring a toner image formed on an image carrier to an intermediate transfer member;

secondary transferring device provided in proximity to said primary transferring device on downstream side of said primary transferring device along a pivotal rotation direction of said intermediate transfer member, for transferring the toner image which has been once held by said intermediate transfer member to a paper; and position determining device abutting against a plane of said intermediate transfer member where said toner image is not held, for determining a position between said primary transferring device and said secondary transferring device.

2. The image forming apparatus according to claim 1, wherein said primary transferring device causes said intermediate transfer member to abut against said image carrier in a wrap shape so as to transfer said toner image to said intermediate transfer member.

3. The image forming apparatus according to claim 1, wherein said secondary transferring device forms a secondary transfer portion by a secondary transfer member which is opposite to a plane of said intermediate transfer member where said toner image is held, said position determining device forms a flat plane portion by said intermediate transfer member, and said flat plane portion is formed and directed to said secondary transfer portion.

4. An image forming apparatus according to claim 3, wherein said flat plane portion formed by said position determining device is inclined at a predetermined angle with respect to a paper transport path in such a manner that a tip portion of said paper is suppressed to be contacted to said intermediate transfer member until said paper reaches said second transfer portion, and that a shock occurred when said tip portion of said paper rushes into said secondary transfer portion is relaxed.

5. An image forming apparatus according to claim 4, wherein said paper transport path is formed on a surface of a toner collecting vessel which collects a toner left on said image carrier, and said paper transport path is formed in such a manner that an angle at which said paper rushes from said paper transport path with respect to said secondary transfer portion is smaller than or equal to 45 degrees.

6. An image forming apparatus according to claim 1, wherein said position determining device is a tension roller for applying tension to said intermediate transfer member.

7. An image forming apparatus comprising:

an image carrier forms a toner image on a surface of said image carrier;

an intermediate transfer member to which the toner image formed on said image carrier is transferred via a primary transfer portion, and which transfers said transferred toner image via a secondary transfer portion to a paper; and a tension roller abutting against a rear surface of said intermediate transfer member so as to apply tension to said intermediate transfer member, wherein said tension roller forms said primary transfer portion, said tension roller forms a flat plane portion directed to said secondary transfer portion, and said tension roller is arranged within a projection area which is directed from a secondary transfer member for forming said secondary transfer portion to said image carrier.

8. The image forming apparatus according to claim 7, wherein said paper transported from a substantially vertical lower direction is entered into said flat plane portion formed by said tension roller at a predetermined angle.

9. The image forming apparatus according to claim 8, wherein said predetermined angle is smaller than or equal to 45 degrees.

10. The image forming apparatus according to claim 8, wherein said predetermined angle is larger than, or equal to 20 degrees and smaller than, or equal to 35 degrees.

11. The image forming apparatus according to claim 7, wherein said intermediate transfer member is a belt member made of an elastic member.

12. An image forming apparatus comprising:

an image carrier in which a toner image is formed on a surface of said image carrier;

an intermediate transfer belt made of an elastic belt, which abuts against said image carrier in a wrap shape at a primary transfer portion, and once holds the toner image formed on said image carrier;

a secondary transfer member for transferring said toner image which is once held on said intermediate transfer belt to a paper at a secondary transfer portion; and a position determining member provided inside said intermediate transfer belt and provided between said primary transfer portion and said secondary transfer portion, for determining both a position of said primary transfer portion and a position of said secondary transfer portion.

13. The image forming apparatus according to claim 12, wherein said position determining member forms a flat plane portion between said position determining member and said secondary transfer member.

14. An image forming apparatus according to claim 12, wherein said position determining member is provided in proximity to said image carrier.

15. The image forming apparatus according to claim 12, wherein said image forming apparatus has an exposing device for forming a latent image every color with respect to said image carrier, and said paper using for secondary-transferring said toner image rushed into said intermediate transfer belt while a latent image of a final color is being formed by said exposing device.

16. An image forming apparatus according to claim 12, wherein while a toner image of a final color is being transferred onto said intermediate transfer belt at said primary transfer portion, a paper which is used to secondary-transfer thereto the toner image rushes into said intermediate transfer belt.

17. An image forming apparatus according to claim 12, wherein said intermediate transfer belt is suspended on said image carrier by a plurality of members including said position determining member so as to form said primary transfer portion.

* * * * *